US005829902A

United States Patent [19]

Fomby

[11] Patent Number: 5,829,902

[45] Date of Patent: Nov. 3, 1998

[54] ADJUSTABLE APPLICATOR BRUSH

[76] Inventor: Kenneth A. Fomby, Rte. 7, Box 435, Gainesville, Tex. 76240

[21] Appl. No.: 879,750

[22] Filed: Jun. 20, 1997

[51] Int. Cl.[6] ..... A46B 11/00

[52] U.S. Cl. ..... 401/127; 401/129

[58] Field of Search ..... 401/127, 129

[56] References Cited

U.S. PATENT DOCUMENTS

| | | | |
|---|---|---|---|
| 790,582 | 5/1905 | Low | 401/127 |
| 835,955 | 11/1906 | Kuter | 401/127 |
| 988,544 | 4/1911 | Bradford | 401/127 |
| 1,607,702 | 11/1926 | Siline et al. | 401/127 X |
| 2,517,663 | 8/1950 | Hendry et al. | 401/127 |
| 3,895,877 | 7/1975 | Fomby | 401/129 |

FOREIGN PATENT DOCUMENTS

| | | | |
|---|---|---|---|
| 558468 | 8/1923 | France | 401/127 |
| 344925 | 4/1960 | Switzerland | 401/127 |

*Primary Examiner*—Steven A. Bratlie
*Attorney, Agent, or Firm*—Jenkens & Gilchrist P.C.

[57] ABSTRACT

An adjustable molded plastic brush having a unitary handle and stem, bristles mounted along an end portion of the stem by a crimped ferrule, circumferentially spaced ribs along the handle, a container cap moveably mounted on the stem and handle between the bristles and the handle ribs, the container cap having an externally threaded slotted nipple having a central bore for the handle and stem, and a circular lock nut mounted on and moveable along the handle and stem having a bore provided with internal threads engage able with the cap nipple to squeeze the portions of the cap nipple against the handle and stem when the lock nut is tightened on the cap nipple for releaseably locking the cap at a desired position along the handle and stem.

1 Claim, 1 Drawing Sheet

ADJUSTABLE APPLICATOR BRUSH

BACKGROUND OF THE INVENTION

1. Field of the Invention

This invention relates to an applicator brush and container cap assembly, and more particularly, relates to an applicator brush and adjustable cap assembly.

2. Description of the Prior Art

Applicator brushes having integral container caps are known in the prior art. U.S. Pat. No. 3,895,877, issued Jul. 22, 1975, discloses applicator brush assemblies including a plastic container cap molded integral with a plastic applicator brush handle and also a metal container cap secured with a molded plastic handle. In each such embodiment of an applicator brush and container cap the container cap is permanently secured at a fixed position on the brush handle.

The present invention departs from the concepts and designs of the prior art in providing an applicator brush in combination with a moveable container cap so that the position of the cap is adjustable along the length of the applicator brush.

SUMMARY OF THE INVENTION

In accordance with the present invention, there is provided an applicator brush in combination with a container cap wherein the position of the container cap along a unitary brush handle and stem is adjustable to permit use of the assembly with containers of various heights and to allow the adjustment of the brush bristles in a container relative to the height of liquid in the container. More specifically, the present invention provides an applicator brush having bristles attached along one end of a stem, a handle formed integral with the other end of the stem, a container cap moveably mounted on the handle and stem having a central bore or aperture sized to permit the cap to move along the handle and stem and a locked nut on the handle and stem and engageable with the cap for locking the cap on the handle and stem.

BRIEF DESCRIPTION OF THE DRAWINGS

The invention will be better understood in conjunction with the drawings wherein.

DESCRIPTION OF THE PREFERRED EMBODIMENTS

Figure 1:
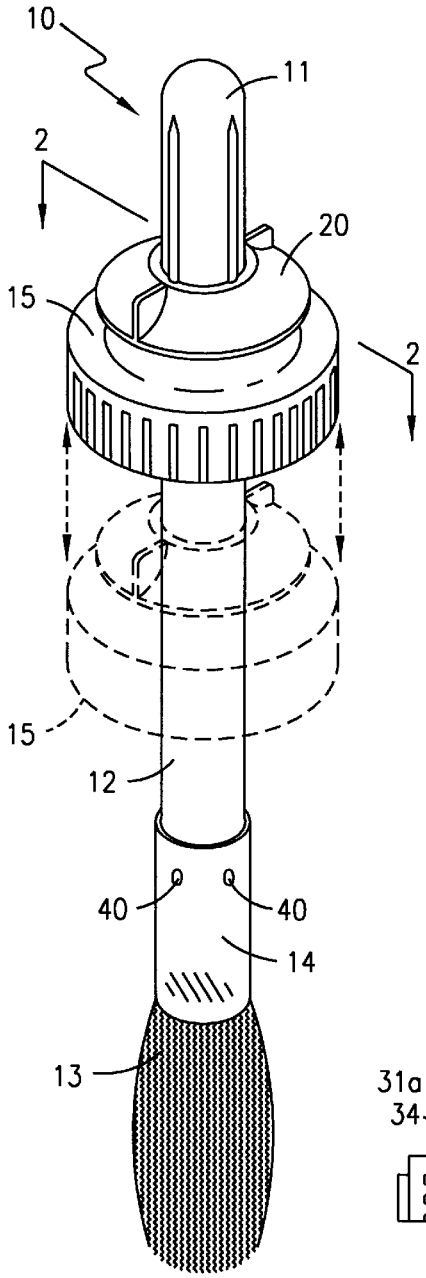
FIG. 1 is a view in longitudinal perspective of an adjustable applicator brush assembly in accordance with the invention, illustrating in phantom lines the moveable feature of the cap along the brush handle and stem.

Referring to FIG. 1 of the drawings, an adjustable applicator brush 10 incorporating the features of the invention includes a unitary handle 11 and stem 12, bristles 13 secured on the lower end of the stem by a ferrule 14, a moveable cap 15 and a lock nut 20. The cap is moveable along the length of the handle-stem and locked in place at a desired location by the lock nut 20.

Figure 3:
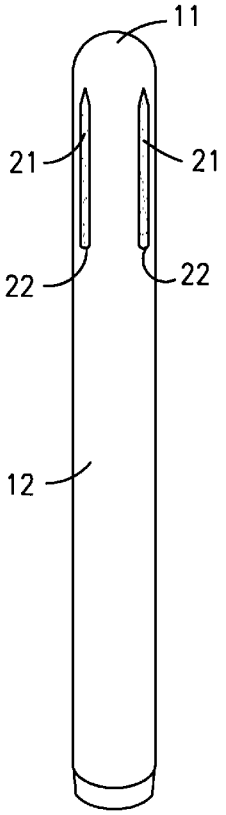
FIG. 3 is a longitudinal view in perspective of the unitary brush handle and stem.

As seen in FIG. 3, the unitary handle-stem is a tubular member having longitudinal, circumferentially spaced, ridges or ribs 21 to facilitate gripping the handle. The lower ends 22 of the ribs provide a stop on the handle defining the upper end of movement of the cap 15 on the handle.

Figure 4:
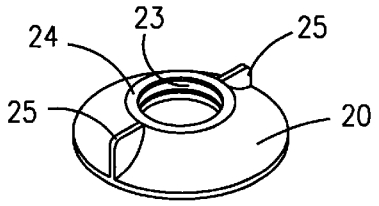
FIG. 4 is a view in perspective of the lock nut.

Referring to FIG. 4, the lock nut 20 is a circular member having an internally threaded tapered bore 23 which is slightly smaller at the top 24 than at the bottom of the nut so that the threaded bore flares slightly outwardly from top to bottom in the nut. The nut 20 also has integral wings 25 on opposite sides of the top of the nut to facilitate gripping and turning the nut on the cap 15.

Figure 5:
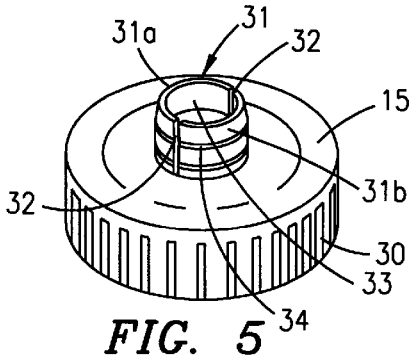
FIG. 5 is a view in perspective of the cap.

The cap 15, as shown in FIG. 5, is a circular member sized to fit a container, not shown, and having external, longitudinal, circumferentially spaced ridges 30 to facilitiate gripping and rotating the cap on the container. The cap has an integral nipple 31 which is slotted along opposite sides at 32 defining opposite side portions 31*a* and 31*b* of the nipple. The cap nipple has a tubular bore 33 which is slightly larger than the external diameter of the handle 11 and stem 12 so that the cap may easily slide along the length of the handle-stem. The nipple has a tapered external thread 34 which is engageable with the internal threads of the bore 23 of the lock nut 20. The threads 34 on the nipple are slightly larger in external diameter than the minimum diameter of the threads 23 in the lock nut so that when the lock nut is tightened on the cap the opposite portions of the nipple 31*a* and 31*b* are squeezed together against the handle-stem to lock the cap at a desired position. The slots 32 between the nipple portions 31*a* and 31*b* permit the nipple portions to move toward each other to squeeze the handle-stem.

Figure 2:
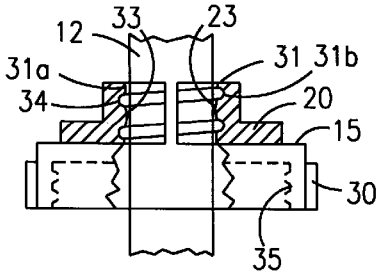
FIG. 2 is a fragmentary view in section and elevation along a longitudinal plane 2—2 illustrated in FIG. 1.

As illustrated in FIG. 2, the cap 15 has internal threads 35 which are sized to engage external threads on a container, not shown.

Figure 6:
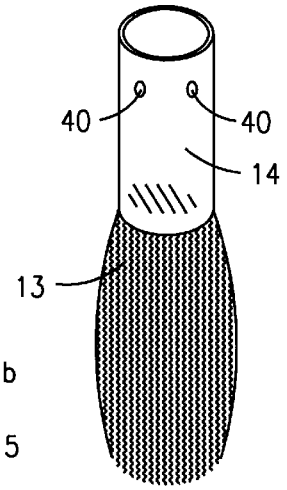
FIG. 6 is a view in perspective of the brush bristles and ferrule for attaching the bristles to the brush stem.

As represented in FIGS. 1 and 6, the brush bristles 13 are secured along a lower end portion of and around the stem 12 by the ferrule 14 which is crimped on the stem at 40.

The applicator brush 10 is assembled by first sliding the lock nut 20 upwardly with the wings 25 facing upwardly on the lower end of the stem 12. The lock nut may slide upwardly on the stem until the lower end edges 22 of the ribs 21 on the handle 11 are engaged by the top face 24 of the lock nut. The cap 15 is then placed on the lower end of the stem 12 with the threaded nipple 31 facing upwardly so that the cap may slide upwardly on the stem until the cap nipple threads 34 engage the internal threads in the bore 23 of the lock nut 20. After installation of the lock nut and cap on the brush stem, the brush bristles are attached on the lower portion on the stem around the stem by the ferrule 14 which is crimped to the stem to firmly secure the bristles on the stem.

With the brush 10 assembled as illustrated in FIG. 1, the brush may be attached on a container, not shown, by threading the cap 15 along the internal threads 35 to external top threads on the container and the position of the brush handle-stem and bristles adjusted to the desired height by sliding the handle and stem upwardly or downwardly through the cap nipple 31 and tightening the nut 20 by rotating the nut on the cap nipple. As the lock nut 20 is turned on the cap, the internal tapered threads in the bore 23 of the lock nut are threaded downwardly on the cap nipple portions 31*a* and 31*b* by the nipple threads 34 until the lock nut is tightly secured on the cap. As the lock nut is turned on the nipple, the tapered threads in the lock nut squeeze the cap nipple portions 31*a* and 31*b* together until the surface of the bore through the nipple tightly grips the brush handle-stem locking the cap at the desired position. The presence of the slots 32 in the cap nipple permit the nipple portions 31*a* and 31*b* to be squeezed together by the tapered threads of the lock nut so that the nipple portions can tightly grip the stem. The cap and lock nut may be positioned on the brush handle-stem at any position desired with the upward movement being limited by the engagement of the top surface 24 of the lock nut with the lower end edges 22 of the ribs 21 on the handle.

It can be seen from the foregoing description and the drawings that the applicator brush of the invention can be readily adjusted to accommadate the brush to containers of various heights and that the depth to which the brush extends into the container can be adjusted to permit the bristles to extend into liquid in the container to the extent desired. The unitary handle-stem, cap, and lock nut may be formed of any desired materials such as metal or molded plastic.

Thus, a very versatile adjustable brush is provided which has advantages over the prior art brushes which include caps mounted at fixed positions along the brush handles and stems.

What is claimed is:

1. An adjustable brush assembly including a container closure cap moveably coupled with a brush handle and stem adapted for moving and releasably locking the brush at selected depths in a container on which the cap is mounted comprising:

(a) a unitary circular closure cap having a cylindrical outer rim provided with external circumferentially spaced ridges for manual gripping of the closure cap and internal threads in the outer rim for attachment of the cap to the container, a circular opening having an axis coincident with the axis of the cap, and a split cylindrical nipple around the opening extending in an opposite direction from the outer rim, the split nipple comprising nipple half portions defining a bore around the circular opening and each having external threads tapering inwardly toward the axis of the opening sloping away from the outer rim of the cap;

(b) a cylindrical brush handle and stem having integral longitudinal circumferentially spaced outer ribs along the handle, the diameter of the handle and stem being sized to form a sliding fit through the opening in the closure cap and the bore within the nipple portions of the closure cap, the handle and stem being engageable by the split nipple portions when the nipple portions are squeezed together to lock the handle and stem with the closure cap, the ends of the ribs on the stem and handle toward the stem being engageable with the ends of the nipple portions to limit the position of the handle and stem in the closure cap;

(c) a circular lock nut having a central tapered internally threaded bore sized to fit on and engage the external threads on the split nipple portions on the closure cap to squeeze the nipple portions together around the handle and stem to lock the handle and stem in the closure cap when the handle and stem is positioned through the closure cap and the lock nut is threaded toward the base of the split nipple portions, the lock nut having integral wings on opposite sides of the lock nut extending away from the outer face of the lock nut for hand engagement and turning of the lock nut; and (d) a brush secured on one end of the stem opposite of the handle end of the handle and stem, the closure cap, handle and stem, and lock nut being formed of molded plastic material.

* * * * *